US009169592B2

(12) United States Patent
Kim et al.

(10) Patent No.: US 9,169,592 B2
(45) Date of Patent: Oct. 27, 2015

(54) WASHING MACHINE AND METHOD OF CONTROLLING THE SAME

(75) Inventors: Seung Hoon Kim, Suwon-si (KR); Hyun Bae Kim, Yongin-si (KR); Seung Jun Lee, Bupyeong-gu (KR); Hyun Sook Kim, Suwon-si (KR); Sung Mo Lee, Gunpo-si (KR); Kyo Soon Choi, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 750 days.

(21) Appl. No.: 12/314,526

(22) Filed: Dec. 11, 2008

(65) Prior Publication Data

US 2009/0260163 A1 Oct. 22, 2009

(30) Foreign Application Priority Data

Apr. 22, 2008 (KR) ..... 10-2008-0037294

(51) Int. Cl.
*D06F 39/08* (2006.01)
*D06F 37/26* (2006.01)
*D06F 39/12* (2006.01)

(52) U.S. Cl.
CPC ..... *D06F 37/26* (2013.01); *D06F 39/12* (2013.01)

(58) Field of Classification Search
USPC ..... 8/158, 159; 68/23.5, 12.12, 12.19
See application file for complete search history.

(56) References Cited

U.S. PATENT DOCUMENTS

| | | | | |
|---|---|---|---|---|
| 3,570,272 | A * | 3/1971 | Douglas | 68/12.01 |
| 4,843,671 | A * | 7/1989 | Hirooka et al. | 8/159 |
| 5,890,247 | A * | 4/1999 | Erickson et al. | 8/158 |
| 7,287,292 | B2 * | 10/2007 | Kim | 8/158 |
| 2002/0016997 | A1 * | 2/2002 | Jonsson | 8/159 |
| 2005/0103063 | A1 * | 5/2005 | Namkung et al. | 68/24 |
| 2006/0000029 | A1 * | 1/2006 | Park | 8/158 |
| 2006/0101586 | A1 * | 5/2006 | Park et al. | 8/149 |
| 2008/0016626 | A1 * | 1/2008 | Oak et al. | 8/158 |

FOREIGN PATENT DOCUMENTS

| | | | |
|---|---|---|---|
| DE | 29520300 | U1 | 2/1996 |
| DE | 19731667 | A1 | 1/1999 |
| KR | 1995-0011690 | | 5/1995 |
| KR | 10-2006-0089300 | | 8/2006 |
| KR | 10-2006-0102926 | | 9/2006 |
| KR | 10-2007-0003356 | | 1/2007 |
| KR | 10-2007-0026923 | | 3/2007 |
| KR | 10-0802466 | | 2/2008 |
| WO | WO2006/027149 | A1 | 3/2006 |
| WO | WO 2006043775 | A1 * | 4/2006 |

OTHER PUBLICATIONS

Machine Translation of Kim, KR 10-2007-0026923, Sep. 2007.*
European Search Report for corresponding European Patent Application No. 09153923.9 dated Aug. 12, 2009, 5 pgs (in English).
Korean Notice of Allowance dated Apr. 29, 2015 in corresponding Korean Patent Application No. 10-2008-0037294.

* cited by examiner

*Primary Examiner* — David Cormier
(74) *Attorney, Agent, or Firm* — Staas & Halsey LLP

(57) ABSTRACT

Disclosed herein are a washing machine and a method of controlling the same that are capable of removing bubbles from a door after washing. The washing machine includes a drum and a door to open and close the drum. The method of controlling the washing machine includes determining whether the present operation is a spin-drying operation, and, when the present operation is the spin-drying operation, supplying water to the door to remove residual bubbles from the door.

2 Claims, 6 Drawing Sheets

WASHING MACHINE AND METHOD OF CONTROLLING THE SAME

CROSS-REFERENCE TO RELATED APPLICATIONS

This application claims the benefit of Korean Patent Application No. 2008-0037294, filed on Apr. 22, 2008 in the Korean Intellectual Property Office, the disclosure of which is incorporated herein by reference.

BACKGROUND

1. Field

The present invention relates to a washing machine and a method of controlling the same, and, more particularly, to a washing machine and a method of controlling the same that are capable of removing bubbles from a door after washing.

2. Description of the Related Art

Generally, a washing machine (typically, a drum type washing machine) is an apparatus, including a water tub to store water (wash water or rinse water), a cylindrical drum rotatably installed in the water tub to receive laundry, and a motor to generate a drive force necessary to rotate the drum, to lift the laundry in the drum along the inner wall of the drum and drop the lifted laundry, during the rotation of the drum, thereby washing the laundry. In front of the drum is installed a door, normally made of glass, to allow laundry to be put into the drum or taken out of the drum therethrough.

The washing machine performs washing through a series of operations, such as a washing operation to separate contaminants from laundry with water containing a detergent (specifically, wash water), a rinsing operation to rinse bubbles or residual detergent from the laundry with water containing no detergent (specifically, rinse water), and a spin-drying operation to spin-dry the laundry.

In the washing machine, however, when a general detergent (not a drum-exclusive detergent) is used, or an excessive amount of the detergent is used, during washing, a large number of bubbles are generated, and the bubbles remain at the glass surface, the edge, and the inside of a door. Even after rinsing, the residual bubbles are not completely removed, with the result that the door glass is stained. In this case, a user may recognize that the rinsing has not been proper, which leads to the user's dissatisfaction with respect to the rinsing performance of the washing machine. In addition, it is inconvenient for the user to periodically clean the door to remove the stains from the door.

In order to solve these problems, conventional measures have been suggested to modify the structure of a detergent box or add a door cleaning hose. However, these measures require a change in structure of the washing machine and the addition of an additional device.

SUMMARY

Accordingly, it is an aspect of the present invention to provide a washing machine and a method of controlling the same that are capable of supplying water to a door glass through a water supply valve or a steam valve, during spin-drying, thereby effectively removing residual bubbles from a door without any structural change.

It is another aspect of the present invention to provide a washing machine and a method of controlling the same that are capable of supplying water to the door glass through a circulation pump before drainage after washing or rinsing, thereby removing residual bubbles from the door without any structural change.

Additional aspects and/or advantages will be set forth in part in the description which follows and, in part, will be apparent from the description, or may be learned by practice of the invention.

The foregoing and/or other aspects of the present invention may be achieved by providing a method of controlling a washing machine including a drum and a door to open and close the drum, the method including determining whether a current operation of the washing machine is a spin-drying operation, and, supplying water to the door to remove residual bubbles from the door if determined that the current operation is the spin-drying operation.

The supplying water to the door to remove residual bubbles from the door may include controlling the water to flow to the door through a valve to supply water into the drum.

The supplying water to the door to remove residual bubbles from the door may include driving the valve for a predetermined time to remove residual bubbles from the door.

The valve may include a water supply valve or a steam valve.

The method may further include, when the present operation is the spin-drying operation, detecting a rotating speed of the drum, and the supplying water to the door to remove residual bubbles from the door includes supplying water to the door when the rotating speed of the drum reaches a predetermined speed.

The spin-drying operation may include an intermediate spin-drying operation after washing or rinsing.

The spin-drying operation may include a final spin-drying operation.

In accordance with another aspect, the present invention may include a method of controlling a washing machine including a drum and a door to open and close the drum, the method including determining whether a washing or rinsing operation has been completed, and, when the washing or rinsing operation has been completed, supplying water to the door to remove residual bubbles from the door.

The supplying water to the door to remove residual bubbles from the door may be performed before the commencement of a draining operation after the completion of the washing or rinsing operation.

The supplying water to the door to remove residual bubbles from the door may include controlling the water to flow to the door through a circulation unit to circulate water into the drum.

The supplying water to the door to remove residual bubbles from the door may include driving the circulation unit for a predetermined time before the commencement of the draining operation to remove residual bubbles from the door.

The method may further include, after removing residual bubbles from the door, performing a draining operation, determining whether a spin-drying operation is entered into after the draining operation, and, after the entry of the spin-drying operation, supplying water to the door to remove residual bubbles from the door.

The supplying water to the door to remove residual bubbles from the door after the entry of the spin-drying operation may include controlling water to flow to the door through a valve to supply water into the drum.

The foregoing and/or other aspects of the present invention may be achieved by providing a washing machine including a drum, a door to open and close the drum, a valve to supply water to the door, and a controller to control the valve, during a spin-drying operation, to perform a process to remove residual bubbles from the door.

The washing machine may further include a speed detector to detect a rotating speed of the drum, and, when the rotating speed of the drum reaches a predetermined speed, the controller controls a water supply unit to supply water to the door.

The washing machine may further include a circulation unit to circulate water in the drum, and, when a washing or rinsing operation has been completed, the controller controls the circulation unit to remove residual bubbles from the door.

The controller may drive the circulation unit for a predetermined time before the commencement of a draining operation after the completion of the washing or rinsing operation to supply water to the door.

BRIEF DESCRIPTION OF THE DRAWINGS

These and/or other aspects and advantages will become apparent and more readily appreciated from the following description of the embodiments, taken in conjunction with the accompanying drawings, of which.

DETAILED DESCRIPTION OF EMBODIMENTS

Figure 1:
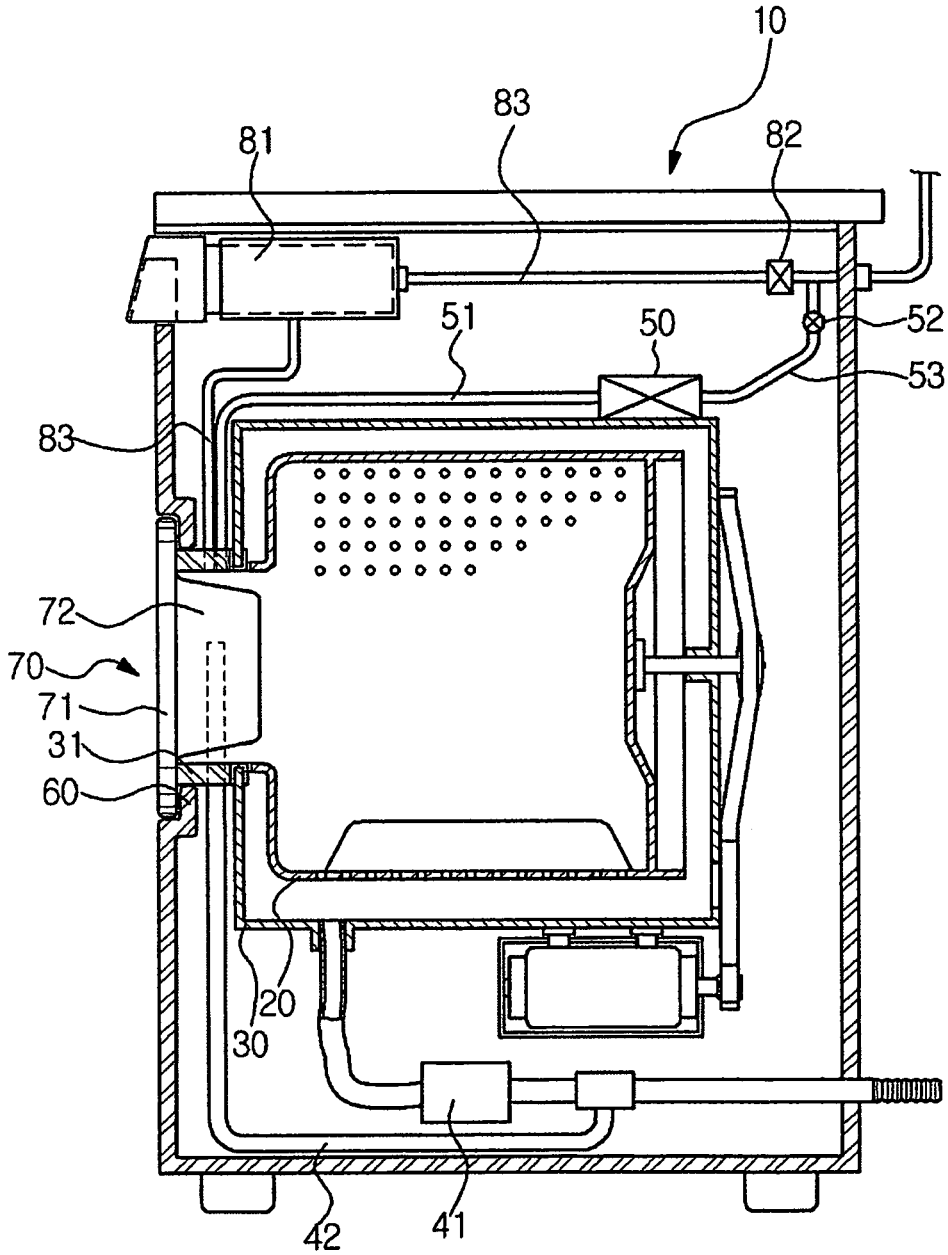
FIG. 1 is a view schematically illustrating a washing machine according to an embodiment of the present invention.

Reference will now be made in detail to the embodiments, examples of which are illustrated in the accompanying drawings, wherein like reference numerals refer to the like elements throughout. The embodiments are described below to explain the present invention by referring to the figures.

Figure 2:
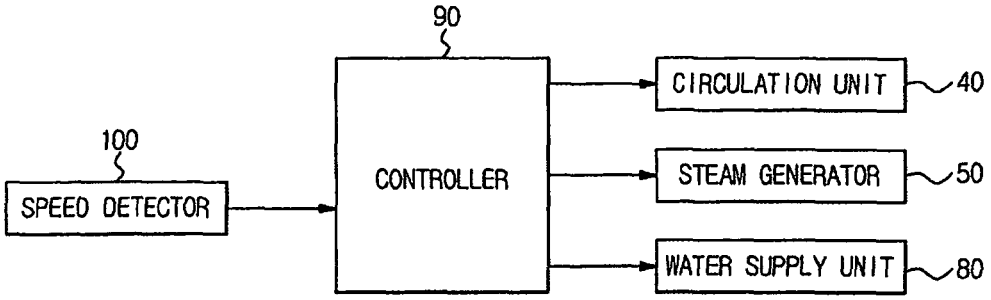
FIG. 2 is a control block diagram of the washing machine according to the embodiment of the present invention.

FIG. 1 is a constructional view schematically illustrating a washing machine according to an embodiment of the present invention. The washing machine includes a machine body 10, a drum 20, a water tub 30, a circulation pump 41, a circulation pipe 42, a steam generator 50, a steam supply pipe 51, an inlet port 60, a door 70, and a water supply unit 80 (FIG. 2).

The machine body 10 forms the external appearance of the washing machine. The inlet port 60, through which laundry is put into the drum 20 and taken out of the drum 20, is formed at the machine body 10. The door 70 is installed at the region where the inlet port 60 of the machine body 10 is formed to open and close the inlet port 60.

The drum 20 is rotatably installed in the machine body. The open side of the drum 20 is directed to the inlet port 60 of the machine body 10 such that the laundry is put into the drum 20 through the door 70.

The drum 20 is provided at the circumference thereof with a plurality of holes through which water (wash water or rinse water) is introduced into the drum 20.

The water tub 30 is constructed in a shape corresponding to that of the drum 20. The water tub 30 is installed outside the drum 20. The open side of the water tub 30 is directed to the inlet port 60. Water (wash water or rinse water) is received in the water tub 30.

A diaphragm 31 to seal between the door 70 and the inlet port 60 is installed at the inner circumference of the water tub 30.

The diaphragm 31 is made of a material exhibiting elasticity and flexibility, such as rubber. The diaphragm 31 is connected to the inlet port 60 disposed in front of the machine body 10 to prevent the leakage of water supplied into the water tub 30 out of the door 70.

The diaphragm 31 is provided at the inner circumference thereof with holes (not shown) through which the circulation pipe 42, the steam supply pipe 51, and a water supply pipe 83 are inserted such that, when water is supplied through the circulation pipe 42, the steam supply pipe 51, and a water supply pipe 83, the water can be introduced into the drum 12.

A circulation unit 40 pumps the water in the water tub 30 out of the water tub 30 and resupplies the pumped water to the water tub 30 and the drum 20. That is, the circulation unit 40 circulates water in the water tub 30 and the drum 20.

The circulation unit 40 includes the circulation pump 41 to pump the water discharged to the bottom of the water tub 30 and the circulation pipe 42 to suction the water discharged to the bottom of the water tub 30 and redischarge the suctioned water to the outside of the circulation pump 41 such that the water can be introduced into the drum 20.

That is, the circulation pump 41 performs a pumping action to redischarge the introduced water. The water discharged from the circulation pump 41 rises along the circulation pipe 42, and is resupplied to the side of the drum 20, with the result that the laundry put in the drum 20 is uniformly wetted, and, at the same time, the water is saved.

In addition to its original function, the circulation unit 40 drives the circulation pump 41 for a first predetermined time before a draining operation after a washing or rinsing operation, such that the water pumped through the circulation pipe 42 flows along the side of the door 70, to remove residual bubbles from a door glass 72.

The steam generator 50 is installed inside the machine body 10 and outside the water tub 30. The steam generator 50 drives a steam valve 52 to receive water from a pipe 53 diverging from the water supply unit 80, heats the supplied water, and supplies steam into the drum 20 through the steam supply pipe 51 to heat the laundry and water during a washing operation or a rinsing operation.

In addition to its original function, the steam generator 50 drives the steam valve 52 for a second predetermined time, when the speed of the drum 20 reaches a predetermined speed (approximately 150 rpm) during an intermediate spin-drying operation or a final spin-drying operation, to receive a small amount of water from the pipe 53 diverging from the water supply unit 80 such that the water can flow from the upper end to the lower end of the door glass 72.

Also, the steam generator 50 drives the steam valve 52 before a draining operation after a washing or rinsing operation to receive a small amount of water from the pipe 53 diverging from the water supply unit 80 such that the water can flow from the upper end to the lower end of the door glass 72.

The steam supply pipe 51 is inserted through the diaphragm 31 to supply water to the door glass 72 through the diaphragm 31.

The door 70 opens and closes the inlet port 60. The door 70 includes a ring-shaped frame 71 and the glass 72 installed at the inner circumference of the frame 71. The glass 72 is formed in the shape of a transparent container.

When the door 70 is closed, the inner circumference of the glass 72 comes into contact with the diaphragm 31 to prevent the leakage of water to the outside during washing or rinsing. However, as the inside lower end of the door glass 72 comes into contact with the diaphragm 31, bubbles generated during the washing or the rinsing remain between the inside lower end of the door glass 72 and the diaphragm 31.

The water supply unit 80 is connected to an external water pipe to supply water into the drum 20 and the water tub 30 during a washing operation or a rinsing operation. The water supply unit 80 includes the water supply pipe 83 along which water flows during the washing operation or the rinsing operation and a water supply valve 82 to allow or interrupt the supply of water.

The water supply pipe 83 is connected to a detergent box 81 such that a detergent can be supplied along with water during a washing operation or a rinsing operation.

The water supply unit 80 further includes the pipe 53 diverging from the water supply unit 80. The diverging pipe 53 is connected to the steam generator 50.

In addition to its function to supply water into the drum 20 and the water tub 30 during a washing operation or a rinsing operation, the water supply unit 80 opens the water supply valve 82, during a spin-drying operation, such that water can flow to the door glass 72 through the water supply pipe 83.

Also, the water supply unit 80 drives the water supply valve 82 before a draining operation after a washing or rinsing operation such that supplied water can flow from the upper end to the lower end of the door glass 72.

The water supply pipe 83 is inserted through the diaphragm 31 to supply water to the door glass 72 through the diaphragm 31.

Also, the water supply unit 80 supplies water to the diverging pipe 53, when the steam valve 52 is opened during a spin-drying operation, such that the water can flow from the upper end to the lower end of the door 70 through the steam generator 50.

FIG. 2 is a control block diagram of the washing machine according to the embodiment of the present invention. The washing machine includes the circulation unit 40, the steam generator 50, the water supply unit 80, a controller 90, and a speed detector 100.

Figure 3:
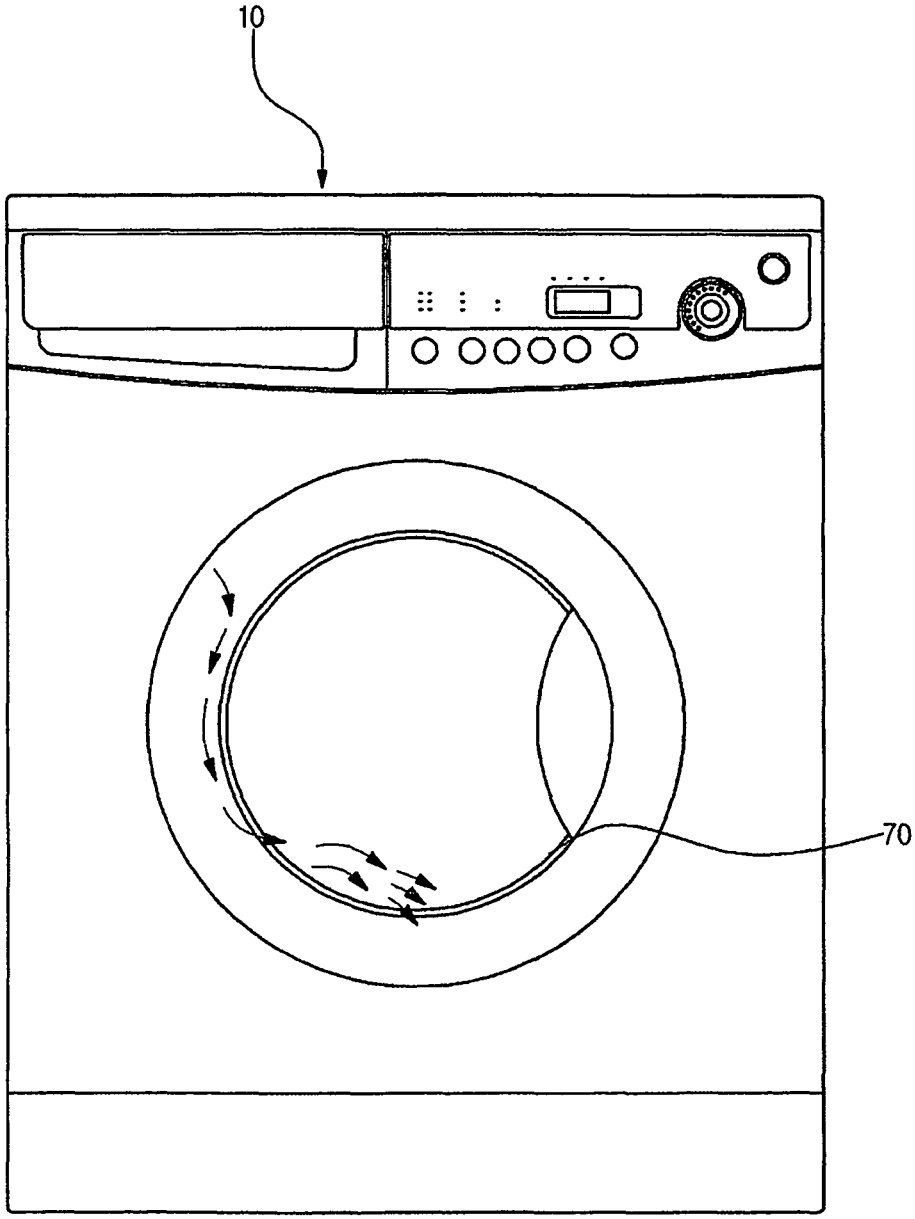
FIG. 3 is a view illustrating a first removal of bubbles from a door of the washing machine according to the embodiment of the present invention.

The circulation unit 40 drives the circulation pump 41 for a first predetermined time before a draining operation after a washing or rinsing operation, such that water flows along the side of the door glass 72 through the circulation pipe 42 of the circulation unit 40, as shown in FIG. 3, to remove residual bubbles from the door glass 72.

Figure 4:
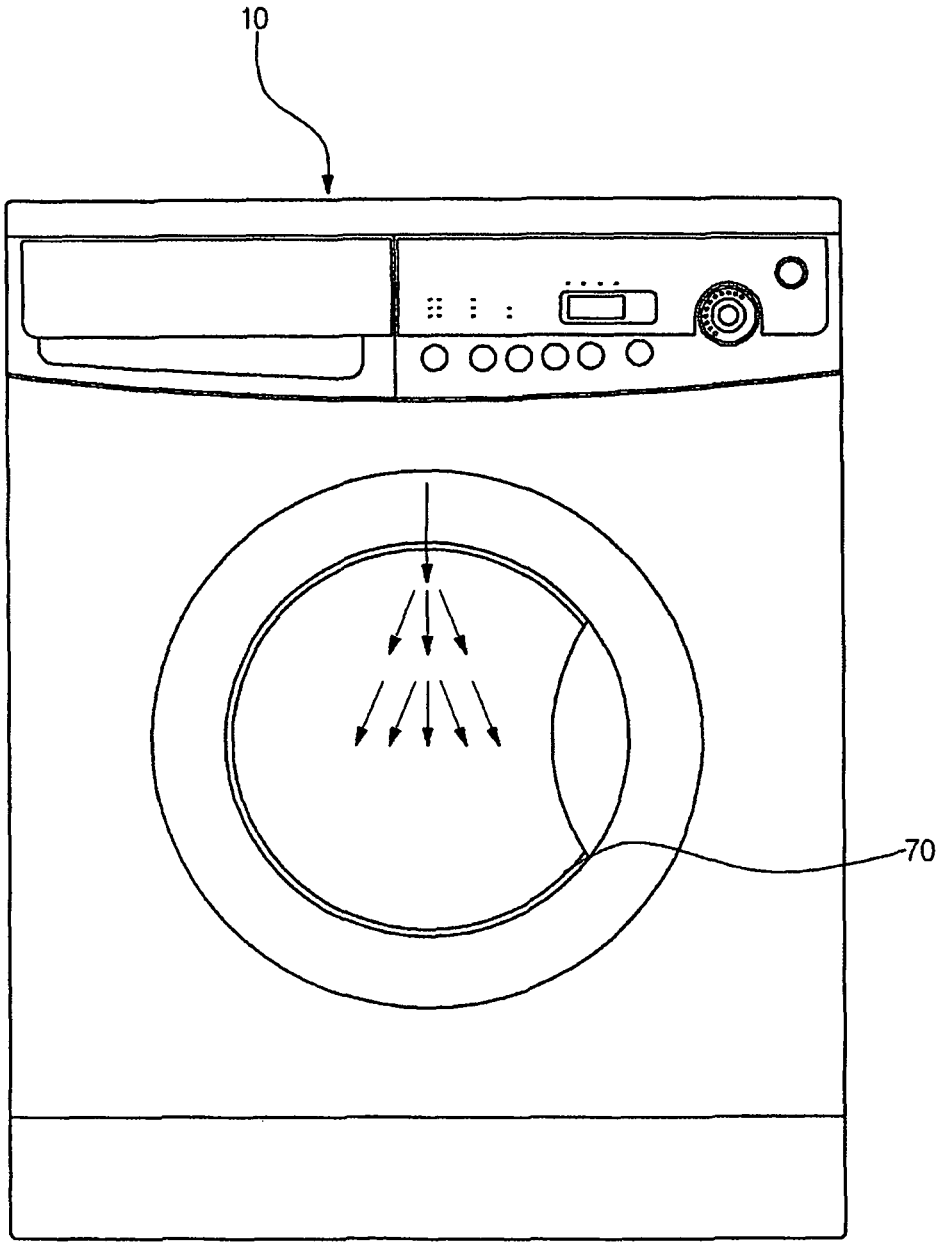
FIG. 4 is a view illustrating a second removal of bubbles from a door of the washing machine according to the embodiment of the present invention.

The steam generator 50 opens the steam valve 52 for a second predetermined time, as shown in FIG. 4, when the rotating speed of the drum 20 reaches a predetermined speed (approximately 150 rpm) during a spin-drying operation, such that a small amount (approximately 0.3 L) of water can flow from the upper end to the lower end of the door glass 72.

Also, the steam generator 50 opens the steam valve 52 before a draining operation after a washing or rinsing operation such that a small amount of water can flow from the upper end to the lower end of the door glass 72.

The water supply unit 80 opens the water supply valve 82 for a second predetermined time, when the rotating speed of the drum 20 reaches a predetermined speed during a spin-drying operation, such that water can flow from the upper end to the lower end of the door glass 72.

Also, the water supply unit 80 opens the water supply valve 82 before a draining operation after a washing or rinsing operation such that a small amount of water can flow from the upper end to the lower end of the door glass 72.

The controller 90 determines the points of time when a washing operation, a rinsing operation, and a spin-drying operation are performed and the point of time when water is drained after the washing operation and the rinsing operation.

That is, the controller 90 determines the point of time when the washing or rinsing operation is completed and controls the operation of the circulation pump 41 of the circulation unit 40 before a draining operation after the completion of the washing or rinsing operation to drive the circulation pump 41 for a first predetermined time to remove residual bubbles from the inside of the door glass 72.

In this embodiment, the controller 90 controls the driving of the circulation pump 41 to remove residual bubbles from the door glass 72 with the water used to wash or rinse without additional supply of water. Alternatively, the controller 90 may control the driving of the water supply valve 82 or the steam valve 52, such that a small amount of water can further flow to the door 70, to remove residual bubbles from the inside of the door glass 72.

After determining the point of time when a spin-drying operation is performed, the controller 90 drives the water supply valve 82 or the steam valve 52 during the spin-drying operation, such that water can flow to the door glass 72, to remove residual bubbles from the inside of the door glass 72.

At this time, the controller 90 may control the driving of the water supply valve 82 of the water supply unit 80 and/or the steam valve 52 of the steam generator 50 to remove residual bubbles from the door glass 72.

The controller 90 receives the rotating speed of the drum from the speed detector 100 during the spin-drying operation and compares the received rotating speed of the drum 20 with a predetermined speed.

When the current rotating speed of the drum 20 reaches the predetermined speed, the controller 90 controls the water supply valve 82 or the steam valve 52 such that water can flow to the door 70.

Figure 5:
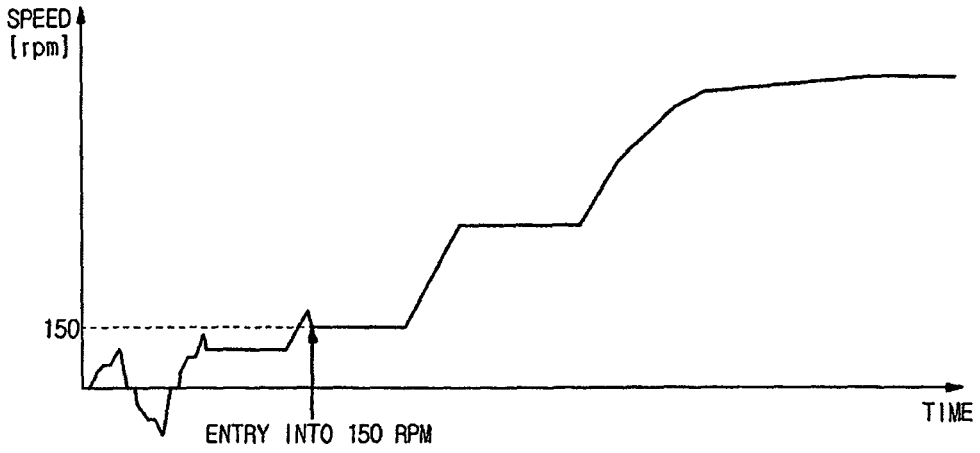
FIG. 5 is a graph illustrating the change in rotating speed of the washing machine according to the embodiment of the present invention during spin-drying.

At this time, the predetermined speed is approximately 150 rpm, as shown in FIG. 5, which is a speed at which a probability of the drum 20 being filled with water is low, and therefore, even when water is supplied to the door 70, the drum 20 is not filled with water.

The speed detector 100 detects the rotating speed of the drum 20 during a spin-drying operation and transmits the detected speed to the controller 90.

Figure 6:
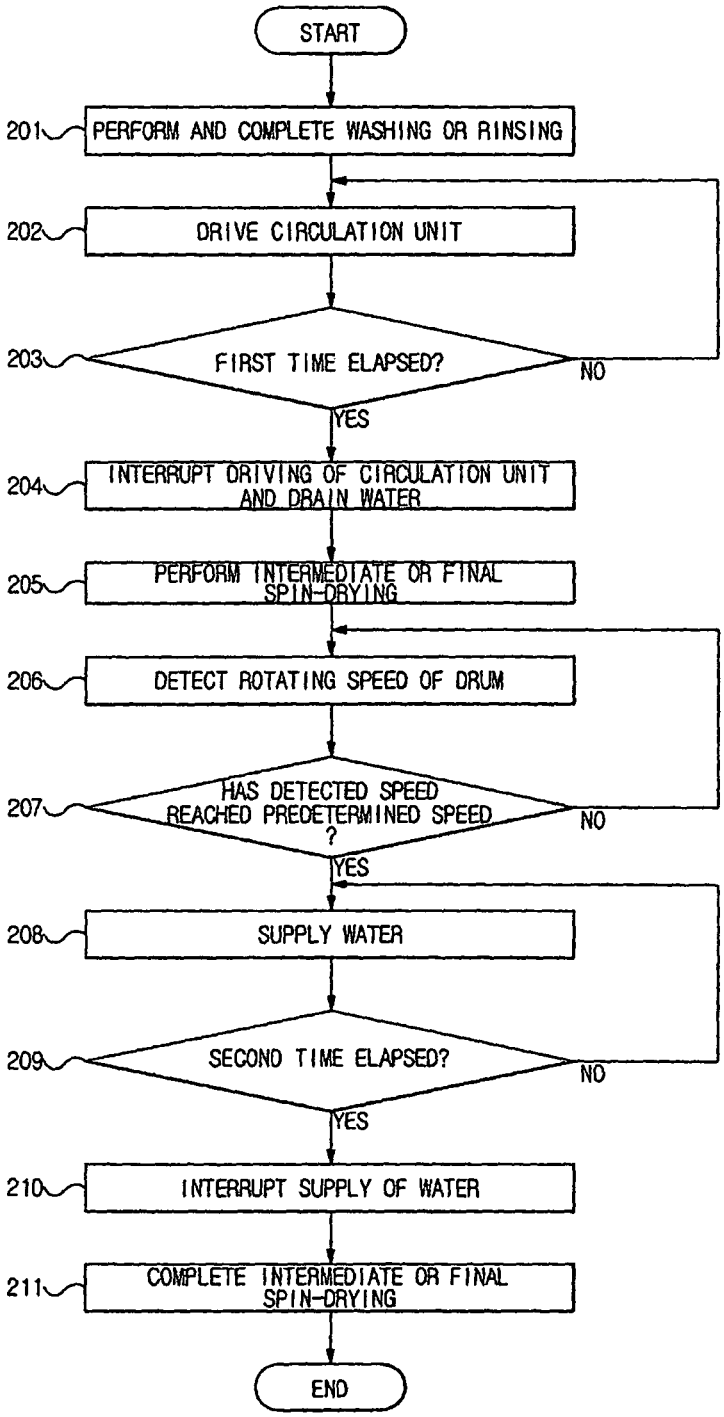
FIG. 6 is a flow chart illustrating a method of controlling a washing machine according to an embodiment of the present invention.

FIG. 6 is a flow chart illustrating a method of controlling a washing machine according to an embodiment of the present invention. The method of controlling the washing machine will be described with reference to FIGS. 1 and 2.

When a user puts laundry into the drum 20 and inputs a course to perform a washing operation, water sufficient to wet the laundry is introduced into the drum 20 and the water tub 30 through the water supply pipe 83 of the water supply unit 80 according to a control signal of the controller 90, and a washing or rinsing operation is commenced according to the inputted course.

During the washing or rinsing operation, the supplied water is circulated through the circulation pump 41 and the circulation pipe 42 of the circulation unit 40.

After the washing or rinsing operation is completed (201), bubbles remain inside the door glass 72 at the inside lower end of the door 70.

Accordingly, the circulation pump 41 of the circulation unit 40 is driven for a first time (approximately 10 seconds) before drainage after the completion of the washing or rinsing operation (202), such that the water pumped through the circulation pump 42 can flow along the side of the door 70, to remove residual bubbles from the inside of the door glass 72.

At this time, the circulation pump 41 is operated before the drainage since it is required for the drum 20 to be filled with water.

When the first time to drive the circulation pump 41 elapses (203), the driving of the circulation pump 41 is stopped and a draining operation is performed (204). Subsequently, an intermediate or final spin-drying operation is performed (205).

During the intermediate or final spin-drying operation, the rotating speed of the drum 20 is detected by the speed detector 100 (206), and it is determined whether the rotating speed of the drum 20 has reached a predetermined speed (207).

At this time, the predetermined speed is approximately 150 rpm, which is a speed at which a probability of the drum 20 being filled with water is low, and therefore, even when water flows to the door 70, the drum 20, is not filled with water.

When the rotating speed of the drum 20 reaches the predetermined speed, the steam valve 52 of the steam generator 50 or the water supply valve 82 of the water supply unit 80 is opened for a second time (approximately 60 seconds), such that a small amount (approximately 0.3 liters) of water can flow to the door glass 72, to remove residual bubbles from the inside of the door 70 (208).

After the second time elapses (which water flows to the door 70) (209), the driving of the steam valve 52 or the water supply valve 82 is stopped to interrupt the supply of water (210), and a spin-drying operation is controlled to be performed for a predetermined spin-drying time (211).

In this way, the circulation pump 41 is driven, before the commencement of the draining operation after the completion of the washing or rinsing operation, such that water can flow along the side of the door 70 through the circulation pipe 42, to primarily remove residual bubbles from the door glass 72.

In this embodiment, the circulation pump 41 is driven to remove residual bubbles from the door glass 72 with the water used to wash or rinse without additional supply of water. However, the present invention is not limited to the illustrated embodiment. For example, a small amount of water may be controlled to further flow to the door 70 through the water supply valve 82 of the steam valve 52 to remove residual bubbles from the inside of the door glass 72.

When the rotating speed of the drum 20 reaches a predetermined speed, during the intermediate or final spin-drying operation after the drainage, the water supplied through the water supply valve 82 or the steam valve 52 is controlled to flow to the door 70 to secondarily remove residual bubbles from the lower end of the door glass 72.

At this time, the rinsing or the intermediate spin-drying operation is repeatedly performed according to the course inputted by the user. The removal of bubbles during a washing operation may be achieved by one or several rinsing operations.

To achieve the removal of bubbles, one or several intermediate spin-drying operations or a final spin-drying operation may be performed.

As apparent from the above description, it is possible to supply water to the door glass through the water supply valve or the steam valve, during spin-drying, such that the water can flow from the upper end to the lower end of the door glass. Consequently, the embodiment of the present invention has the effect of effectively removing residual bubbles from the door without any structural change. Also, it is possible to supply water to the door glass through the circulation pump before drainage after washing or rinsing, such that the water can flow along the side of the door glass, to remove residual bubbles from the door without any structural change.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A method of controlling a washing machine including a machine body having an inlet port, a drum, a water tub, a door to open and close the inlet port, a diaphragm to seal between the door and the inlet port installed at an inner circumference of the water tub, a door glass which protrudes from an inside of the door, a water supply unit to supply external water, and a circulation unit to circulate water contained in the water tub into the drum and performing a washing operation or a rinsing operation, the method comprising:

determining whether the washing operation or the rinsing operation is complete;

supplying water contained in the water tub to a space between the diaphragm and the door glass to flush a lateral surface of the door glass by operating the circulation unit;

determining whether an operating time of the circulation unit elapses a predetermined first time by counting the operating time of the circulation unit;

stopping the operation of the circulation unit if the operating time elapses the predetermined first time;

performing a draining operation to drain water contained in the water tub;

determining a spin-drying operation of the washing machine has begun, after the draining operation;

determining a rotating speed of the drum has reached a predetermined speed; and supplying water to the space between the diaphragm and the door glass to flush the lateral surface of the door glass by operating the water supply unit in a state which the rotating speed of the drum is maintained at the predetermined speed.

2. The method according to claim 1, wherein the supplying water being supplied to the space flows through a hole formed at the diaphragm from a circulation pump.

* * * * *